US011410840B2

(12) United States Patent
Giannakopulos

(10) Patent No.: US 11,410,840 B2
(45) Date of Patent: Aug. 9, 2022

(54) MASS CALIBRATION OF MASS SPECTROMETER

(71) Applicant: Thermo Fisher Scientific (Bremen) GmbH, Bremen (DE)

(72) Inventor: Anastassios Giannakopulos, Bremen (DE)

(73) Assignee: THERMO FISHER SCIENTIFC (BREMEN) GMBH, Bremen (DE)

( * ) Notice: Subject to any disclaimer, the term of this patent is extended or adjusted under 35 U.S.C. 154(b) by 366 days.

(21) Appl. No.: 16/749,176

(22) Filed: Jan. 22, 2020

(65) Prior Publication Data

US 2020/0258727 A1 Aug. 13, 2020

(30) Foreign Application Priority Data

Feb. 11, 2019 (GB) ..... 1901886

(51) Int. Cl.

*H01J 49/00* (2006.01)
*H01J 49/40* (2006.01)
*H01J 49/42* (2006.01)

(52) U.S. Cl.

CPC ..... *H01J 49/0009* (2013.01); *H01J 49/40* (2013.01); *H01J 49/424* (2013.01); *H01J 49/4225* (2013.01)

(58) Field of Classification Search

CPC .... H01J 49/0009; H01J 49/40; H01J 49/4225; H01J 49/424
USPC ..... 250/281, 282, 283
See application file for complete search history.

(56) References Cited

U.S. PATENT DOCUMENTS

| | | | | |
|---|---|---|---|---|
| 9,418,824 | B2 | 8/2016 | Wildgoose | |
| 9,805,920 | B2 | 10/2017 | Kenny | |
| 2007/0200060 | A1 | 8/2007 | Russ, IV et al. | |
| 2008/0067346 | A1* | 3/2008 | Amster | H01J 49/0009 250/282 |
| 2008/0091370 | A1 | 4/2008 | Gabeler | |
| 2008/0237458 | A1 | 10/2008 | Wang | |
| 2017/0125222 | A1* | 5/2017 | Brown | H01J 49/40 |
| 2019/0074098 | A1* | 3/2019 | Jans | G01T 1/185 |

FOREIGN PATENT DOCUMENTS

| | | | |
|---|---|---|---|
| EP | 3379561 | A1 | 9/2018 |
| GB | 2536536 | A | 9/2016 |
| WO | 2013081581 | A1 | 6/2013 |

OTHER PUBLICATIONS

Combined Search and Examination Report dated Jul. 25, 2019, to GB Patent Application No. 1901886.0.

* cited by examiner

*Primary Examiner* — Nicole M Ippolito

(57) ABSTRACT

Calibration of a mass spectrometer is described. In one aspect, a mass spectrometer can generate an offset value indicative of the mass difference between the corrected and reference external calibrant ion data. By comparing the offset value to a threshold, a preliminary mass calibration can be modified, or a recalibration of the mass spectrometer is performed.

16 Claims, 4 Drawing Sheets

MASS CALIBRATION OF MASS SPECTROMETER

PRIORITY

This application claims priority to UK Patent Application 1901886.0, filed on Feb. 11, 2019, and titled "Mass Calibration of Mass Spectrometer," by Giannakopulos, which is hereby incorporated herein by reference in its entirety.

FIELD OF THE INVENTION

This invention relates to mass calibration of mass spectrometers such as, but not limited to, Fourier Transform Mass Spectrometers (FTMS), for example an Orbitrap™, or to time-of-flight (TOF) or quadrupole mass spectrometers.

BACKGROUND TO THE INVENTION

Mass spectra generally require a form of mass calibration to ensure that the masses reported in the mass spectra are accurate. Typically, a plurality of calibrant species forming a "calibration mix" are measured and the relationship between the measured mass to charge (m/z) ratios of the known calibrant species of ions and their theoretical m/z ratios is determined. The theoretical m/z ratios mean the actual or known m/z ratios. A calibration curve is usually fitted and adjusted to minimize the errors between the experimentally determined values and the theoretical values of the calibration compounds. The calibration curve can then be used in subsequent mass analyses to correct the measured m/z ratios.

The measured m/z (or, in the case of a time of flight MS, the time of flight, which is related to the square root of m/z) shifts over time, due to temporally variable conditions such as temperature fluctuations. Thus, a calibration curve obtained at a certain time is based upon the experimental conditions at that time, and may not provide an accurate m/z of ions analysed subsequently. One way of addressing this problem is through choice of materials and construction so as to minimize the effect of temperature shifts. Such an approach is difficult and expensive and in any event may be ineffective, due to thermal time constraints (thermal inertia) of the affected materials.

As an alternative, it has been proposed to measure the temperature and then adjust the calibration parameters based on the measured temperature. Such an approach is computationally burdensome and it can be challenging to measure the temperature accurately and adequately.

A further approach to address temporal drift is to recalibrate the mass spectrometer—that is to say, to recalculate the calibration curve—on a periodic basis. This requires the use of known mass standards, to allow the calculation of revised/updated calibration curve parameters.

The use of such "calibration mixes"—that is to say, the use of ion species supplied separately to the mass spectrometer, of known m/z—results in difficulties. If the calibration coefficients are recalculated insufficiently frequently, this may result in unacceptable inaccuracies in the m/z or TOF measurements; excessive recalibration negatively affects sample throughput since no sample measurements take place whilst the calibration mix is being analysed, and interferes with the chromatographic process normally used for mass spectrometric analysis.

One solution to this problem of sample throughput is to employ a so called "internal lock mass", that is to say, an ion species mixed with the sample and of known m/z. The internal lock mass may be mixed with the sample during a sample preparation stage, or may result from an environmental contaminant (such as a molecule emitted by the device or its consumables, during a chromatography and/or ionization process), provided that it has a known mass to charge ratio. The sample ion species m/z or TOF can then be corrected in each spectrum using the lock mass. If the measured m/z or TOF of the known lock mass ion has shifted, then the measured m/z or TOF of sample ions is then globally adjusted to correct for the shift. The adjustment which is applied is a global adjustment to the measured mass to charge ratios of all ions and reflects the fact that there has been a global shift in measured mass to charge ratios due e.g. to an increase in temperature.

Various specific approaches to the problem of calibration drift in a mass spectrometer have been discussed in a number of patent publications. For example, U.S. Pat. No. B2-7,518,104 discloses a method for determining when the parameters have changed sufficiently to warrant a recalibration.

U.S. Pat. No. B2-9,881,776 takes a different approach and recalibrates when the analyte signal is below a particular threshold, in order to avoid interference with analyte peaks, so that time available for ms/ms analysis is not taken up by recalibration measurements. U.S. Pat. No. B2-9,805,920 proposes the correction of the calibration coefficients in response to a measured or estimated m/z of either an internal or an external lock mass.

U.S. Pat. No. B-7,053,365 discloses the correction of the measured m/z of a sample by using a standard spectrum previously recorded and stored in a computer memory.

U.S. Pat. No. B-9,418,824 discloses the use of one or more lock mass ions, which are initially mixed with the calibration mix to form an internal lock mass. Subsequently the lock mass(es) are analysed to allow for recalibration. This document indicates that more than one lock mass is needed then, as a result of systematic and residual errors in the spectrum arising from spectral interference.

GB-A-U.S. Pat. No. 2,563,077 utilizes the relative temperature independence of mass analysis in a Fourier transform mass-spectrometer (FTMS) such as an Orbitrap®, to provide cross calibration of a time of flight mass spectrometer.

The above proposals for recalibration as a result of temporal changes in system parameters suffer from various drawbacks. For example, a full recalibration (that is to say, a second or further analysis of a range of calibrant ions in a calibration mix, to allow the derivation of a calibration curve across a range of m/z) may be unacceptably time consuming. Adding a lock mass to a sample spectrum (internal calibration) has problems: for example, the lock mass(es) may interfere with unknown sample analyte peaks, resulting in reduced reliability of lock mass measurements; a means has to be provided to add the lock mass and sample together; and there are time penalties. Furthermore, in ms/ms analysis, an isolated parent ion to be fragmented and the lock mass ion are often at different parts of the mass spectrum and extra ion separation and combination steps are required.

Against this background the present invention seeks to provide an improved method of calibrating a mass spectrometer.

SUMMARY OF THE INVENTION

According to a first aspect of the present invention there is provided a method of calibrating a mass spectrometer as defined in claim 1. The invention also extends to a controller for a mass spectrometer in accordance with claim 13, and a mass spectrometer comprising such a controller.

The present invention leverages the presence of a reagent present in an electron transfer dissociation (ETD). The reagent is used as an external calibrant. Periodically, the mass spectrometer switches from capture and analysis of sample ions, to measuring the mass of the external calibrant. If the measured mass differs from a reference mass by less than a threshold amount, then that difference is used as a basis to adjust the calibration curve of the mass spectrometer. If however the measured mass differs from the reference mass of the external calibrant by more than the threshold, a full recalibration of the mass spectrometer may be undertaken, for example using one or more lock masses entrained with the sample as an internal calibrant, or by using a calibration mix, or otherwise. By reference mass is meant either the theoretical mass, that is, the mass to charge ratio that is calculated based upon the component elements and the charge state of the external calibrant, or data from a previous measurement of the external calibrant that has been corrected using a current preliminary mass calibration.

Such a method thus provides a hybrid solution for mass calibration that optimises sample throughput whilst minimizing the risk of unacceptable errors in mass accuracy resulting from uncorrected calibration curves as system parameters change over time. A relatively rapid and beneficial recalculation of the calibration curve can be achieved when small systems parameter changes occur, yet the method still provides a full recalibration of the mass spectrometer when determined to be analytically desirable. Moreover, a relatively rapid measurement of the external calibrant is feasible, on the basis that the external calibrant may contain only one or two ion species whose masses need to be determined.

The method is particularly suited to time-of-flight mass spectrometers, including high resolution multi-reflection mass spectrometers, wherein the speed of a scan means that the time required for the external calibrant analysis is typically in the order of a millisecond or less. Time of flight mass spectrometers are also more sensitive to temperature changes than, for example, FTMS/orbital trapping mass spectrometers so that recalibration is desirable more regularly.

Thus, the mass spectrometer may be provided with an informed (data dependent) decision as to when full recalibration is necessary, with relatively minimal interruption to the sample ion throughput. Previous methods have simply proposed a time consuming full recalibration at periodic intervals, independently of any information suggesting that a full recalibration is actually necessary, or alternatively is overdue.

The use of an external calibrant furthermore avoids any possibility of interference of calibrant peaks with sample peaks that could reduce the reliability of the calibration.

BRIEF DESCRIPTION OF THE DRAWINGS

The invention may be put into practice in a number of ways and some embodiments will now be described by way of example only and with reference to the accompanying Figures in which.

DETAILED DESCRIPTION OF PREFERRED EMBODIMENTS

Throughout the following description, the term "mass" is employed. It is to be understood that this term refers, strictly, to the mass to charge ratio m/z.

Figure 1:
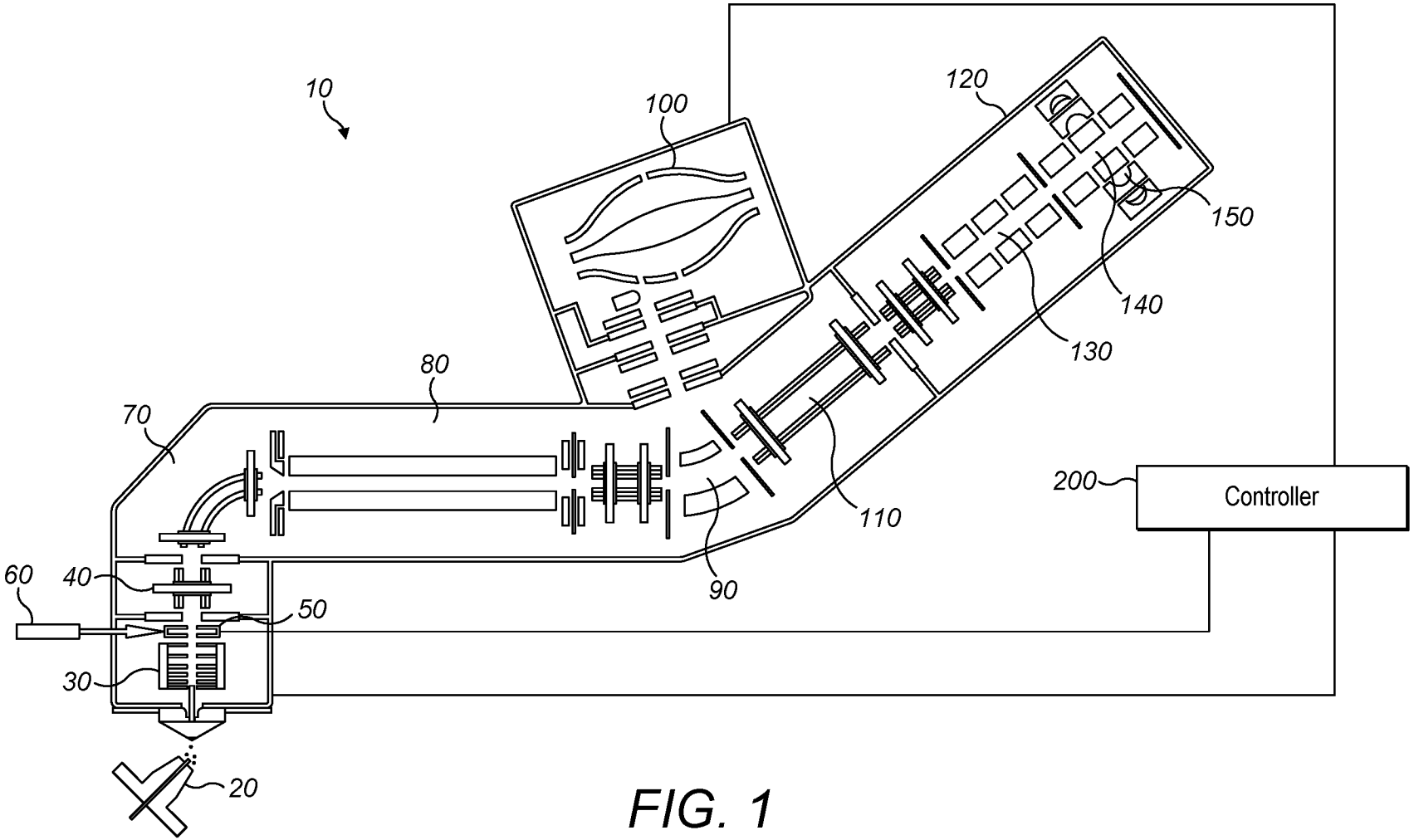
FIG. 1 shows a schematic layout of a mass spectrometer suitable for implementation of the mass calibration techniques that embody the present invention.

FIG. 1 shows a mass spectrometer 10 exemplifying an arrangement for the implementation of embodiments of the invention. The arrangement shown in FIG. 1 is a schematic view of the Orbitrap® Fusion Tribrid series of mass spectrometers manufactured and sold by Thermo Fisher Scientific, Inc. It is to be reiterated that the arrangement of FIG. 1, which employs as a mass analyser an ultra high field Orbitrap® mass analyser, has been chosen simply for the purposes of illustrating the mass calibration techniques embodying the present invention. Other configurations of mass analyser could equally be employed, such as (but not limited to) other forms of Fourier Transform Mass Spectrometer (FTMS), Linear Ion Trap (LIT), Time of flight mass spectrometer (TOF-MS) and the like.

The mass spectrometer 10 of FIG. 1 includes a primary ion source 20 such as an electrospray ionization (ESI) or atmospheric pressure chemical ionization (APCI) source. Ions from a sample to be analysed are generated at atmospheric pressure and are directed at an angle to a skimmer cone which accepts the ions into a first vacuum chamber of the mass spectrometer 10.

The ions from the primary ion source 20 pass through an S lens (electrodynamic ion funnel) 30. Downstream of the S lens 30 is a second ion source. The second ion source is a reagent ion source (RIS) 50 which is provided to allow electron transfer dissociation (ETD) experiments to be carried out, as will be explained further below. The reagent ion source 50 has its own dedicated introduction system to allow delivery of a highly stable flow of reagent. The RIS 50 is not continuous and the ionisation is switchable on and off. In the preferred embodiment, the reagent is fluoranthene, supplied from a reagent container 60. A Townsend discharge, for example, may be employed to produce thermal electrons which are used to ionize reagent molecules by electron capture so as to generate reagent ETD reagent (fluoranthene) anions. Typically the RIS 50 does not require or include a thermionic filament. It will be appreciated that in other embodiments ETD reagents other than fluoranthene can be utilised.

The RIS 50 generates a very intense, stable current of fluoranthene radical anions having a molecular weight of 202.2 Da and a moderate current of fluoranthene radical cations. As will be described in further detail below, the primary ion source 20 and the RIS 50 are each under the control of a system controller 200 that is able to control the ions that are injected into the downstream components of the mass spectrometer 10.

After passing through the RIS 50, ions enter a second vacuum chamber 40 having an ion guide in it. Ions pass through the ion guide in the second vacuum chamber and exit through an aperture into a further vacuum chamber of the mass spectrometer 10 where they enter an active ion beam guide 70. The ions then enter a quadrupole mass filter 80 where a mass range of ions of analytical interest may be isolated.

Downstream of the quadrupole mass filter 80 is a further ion lens, transfer multipole and a curved linear ion trap (C-trap) 90. The C trap 90 is, as will be understood, operable in various modes so as to trap ions and eject them orthogonally or longitudinally.

In a first mode, ions arriving from the quadrupole mass filter 80 may be ejected along the curved axis of the C trap 90, through an ion routing multipole, and into a dual pressure linear ion trap 120 having a first high pressure trapping cell 130 relatively proximal the inlet to the ion trap and a second, low pressure trapping cell 140 downstream thereof for mass analysis. Sample ions injected into the high pressure cell 130, after optional mass selection by the quadrupole mass filter 80, may be subject to reaction with reagent ions from the reagent ion source 50 that have been separately injected into the high pressure cell. A large surface area detector 150 is positioned proximate to the low pressure cell 140 of the linear ion trap 120 to detect ions.

The linear ion trap 120 is positioned in a "dead end" configuration within the mass spectrometer. Thus, in a second mode of operation, ions may be subject to ETD reactions in the linear ion trap 120 from where they are returned back along the path they followed during injection into the linear ion trap 120. Thus they re-enter the C-trap 90 where they may be trapped and cooled in a curved potential well along the longitudinal axis thereof. Once cooled, the trapped ions can be ejected orthogonally towards a high resolution mass analyser such as an Orbitrap® mass analyser 100. As will be familiar to those skilled in the art, the ions injected into the Orbitrap® rotate and reciprocate around a central axis as coherent packets. An image current is induced in a detector (not shown) as these coherent ions pass it, leading to a transient signal in the time domain that may be converted into a signal in the frequency domain through the use of Fast Fourier transforms or other known mathematical processing. A mass spectrum may then be derived from the resulting frequency domain signal.

In a third mode of operation, ions subject to ETD reactions in the linear ion trap can be passed to the low pressure trapping cell 140 of the linear ion trap 120 for mass analysis.

Further details of the Orbitrap® mass analyser and linear ion trap mass analyser are not relevant to the present invention and will not be described further.

The mass spectrometer 10 is under the control of a system controller 200. Although this carries out various functions, in relation to the present invention, the system controller 200 is configured to control the admission of ions from the primary ion source 20 and the RIS 50 for the reasons explained further in connection with FIGS. 2 and 3 below. The system controller 200 is also in communication with the mass analyser 100.

Having described in general terms a mass spectrometer 10, a first embodiment of a mass calibration method embodying the present invention will now be described with reference to FIG. 2.

The first stage of the mass calibration process according to this embodiment of the invention is to carry out a preliminary calibration of the mass spectrometer 10, using a calibration mix. This is shown at step 300. The calibration mix (or "calmix" for short) contains a plurality of ions of accurately known mass to charge ratio. These are injected into the mass spectrometer via the primary ion source 20 and analysed using the mass analyser 100 in usual manner to obtain a mass spectrum. Alternatively, or additionally, in order to mass calibrate the linear ion trap 120, the calmix ions from the primary ion source 20 can be analysed using the linear ion trap 120. The position (indicative of the measured mass) of sufficiently intense and/or interference free peaks of that mass spectrum are compared with the theoretical masses of those peaks. From this, a preliminary calibration curve for the mass spectrometer can be obtained. As the shown spectrometer 10 has two mass analysers—the Orbitrap 100 and the linear ion trap 120—a calibration curve can be obtained in the above manner for each analyser as required. The specific manner in which the preliminary calibration curve is determined does not form a part of the present invention; the skilled reader will in any event be familiar with existing mathematical techniques employed to obtain calibration curves, such as least squares linear regression, to which curve weighting might be applied, etc.

Once a preliminary calibration curve has been obtained using the calibration mixture, it is stored in memory for use in future experimental analyses (step 310). Next, at step 320, a sample to be analysed is then supplied to the primary ion source 20, for example from a liquid or gas chromatograph (not shown) or otherwise. The sample is analysed in standard fashion to obtain one or more, typically a plurality of, mass spectra; for example precursor ion scans can be performed on the sample ions using either mass analyser 100 or 120, preferably the Orbitrap mass analyser 100, and/or MS/MS scans can be performed. MS/MS can be performed, for example, using collision induced dissociation (CID) or using ETD reagent ions. In one embodiment, mass selected sample ions can be routed to the high pressure cell 130 of the linear ion trap 120, to be trapped therein, and ETD reagent may be supplied from the RIS 50 to mix with the sample ions in the cell 130 so that fragmentation of the sample ions takes place within the cell 130, the fragment ions subsequently being captured by the C-trap 90 and ejected orthogonally to the Orbitrap® mass analyser 100 for analysis. Alternatively, the fragment ions can be analysed using the linear ion trap 120. The preliminary calibration curve stored in the memory of the controller 200 is applied to the resulting measured mass spectrum so as to correct for errors in the measured masses of the sample ions and their fragments.

Such sample analysis is carried out over a first period $t_1$ of a plurality of periods $t_n$ (n=1, 2, 3 . . . ).

At the end of the period $t_1$, the system controller 200 prevents further sample ions from entering the main vacuum chamber of the mass spectrometer 10. This may be done in a number of ways. For example, the system controller 200 may apply a signal to the S lens 50 so as to prevent analyte ions from the primary ion source 20 entering the second vacuum chamber 40. However more preferably, the system controller 200 configures the RF potential applied to the quadrupole mass filter 80 so as to permit passage only of fluoranthene ions, for example by applying a "notch" waveform allowing passage of the fluoranthene ions around 202 Da.

Figure 2:
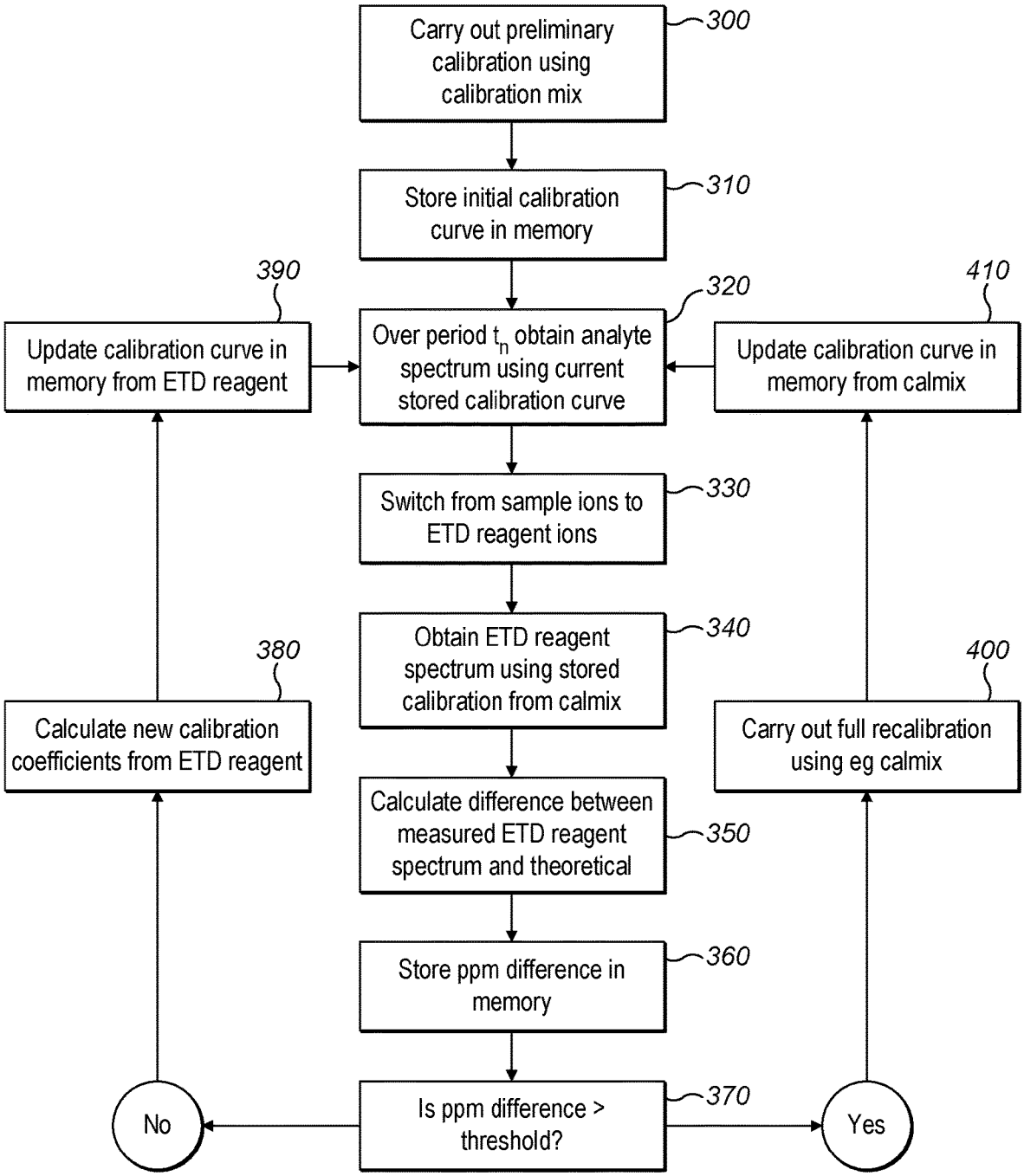
FIG. 2 shows a flow chart of a mass calibration technique according to a first exemplary embodiment of the present invention.

Either way, as shown at step 330 in FIG. 2, during the period $t_1$, only ions from the RIS 50, that is, not also ions from the primary ion source 20, enter the C trap 90. This is an important feature of the present invention: during the period $t_1$ the reagent ions are not employed as an internal calibrant and do not mix with the analyte ions. Instead they are employed as an external calibrant, during the period after $t_1$, i.e., separate from the sample ions. By deliberately preventing the injection of the ETD reagent ions into the sample ion beam (preferably, but not essentially, by having the system controller 200 switch the RIS 50 on and off at the appropriate times) during the analysis of the sample ions, the risk of peaks from the reagent ions interfering with sample ion peaks is avoided.

ETD reagent ions from the RIS 50 are injected into the mass spectrometer 10 as an external calibrant. At step 340, an ETD reagent spectrum is obtained. The RIS 50 thus supplies ETD reagent ions to the mass spectrometer 10 for a period necessary to allow the capture of that ETD reagent spectrum. The advantage of using the ETD reagent as the external calibrant is that such a reagent is already provided in many mass spectrometers for the purpose of fragmenting ions and so an additional external calibrant species is not required.

The position of the fluoranthene peak in the "raw" data obtained is adjusted, in respect of the first loop of FIG. 2 following initial calibration, using the preliminary calibration curve (step 310). In subsequent iterations of the method shown in FIG. 2, the position of the fluoranthene peak may be adjusted using either the preliminary calibration curve or a current stored calibration curve. This will be explained further below.

Once the measured mass of the ETD reagent ions has been adjusted, in the first iteration of FIG. 2, using the preliminary calibration curve, that adjusted measured ETD reagent ion mass is compared with a reference mass, which can be a theoretical mass of the ETD reagent ions stored in the memory of the system controller 200 (step 350). In an alternative embodiment, the reference mass of the ETD reagent could be an adjusted measured ETD reagent ion mass using the preliminary calibration curve where the measured ETD mass was taken between the initial calibration (step 300) and the start of the sample analysis (step 320). A difference (offset value) between the adjusted measured mass and the theoretical mass, in parts per million (ppm), is then also stored in the memory of the system controller 200.

At step 370, logic in the system controller 200 compares the stored mass difference from step 360, with a threshold difference which is also pre-stored in memory. This threshold may be preconfigured as a system setting or it may be user configurable, based upon a trade off of mass accuracy with sample throughput, an aspect that will be discussed in further detail below.

If the comparison determines that the difference is below the stored threshold, then the method proceeds along the logical path shown on the left hand side of FIG. 2. At step 380, the preliminary calibration curve determined prior to the beginning of the experiment using the calibration mix is adjusted. Adjustment of the preliminary calibration curve parameters is based upon the measured difference between the adjusted measured ETD reagent mass and the theoretical mass thereof. In a simplest embodiment, the determined shift between the adjusted measured value and the theoretical value of the ETD reagent mass is used to adjust all of the calibration curve parameters (e.g. all of the calibration coefficients). For example, all of the calibration curve parameters may be adjusted by the same amount (in ppm) as the shift between the adjusted measured value and the theoretical value of the ETD reagent mass. A more sophisticated technique may use weighting. The system controller 200 may store a plurality of pre-obtained calibration curves and that curve which most closely passes by or through the measured adjusted ETD reagent mass may be selected as an updated calibration curve in memory. The pre-obtained calibration curves may have been obtained at different temperatures of the instrument. For example, the system controller 200 could retain some or all of any calibration curves obtained using a calibration mixture and/or internal calibrant (lock masses) in a particular mass spectrometer 10. Many mass spectrometers stay in a single location for long periods, so that calibration curves obtained over long periods of time may be computationally useful. The system controller 200 could use machine learning and/or might weight the more recently obtained full calibration curves (that is, curves which have been obtained using calibration mixes or via internal calibrants) to inform the "best" adjustment to the previously employed calibration curve, when a small shift in the measured mass of the ETD reagent results in the carrying out of steps 380 and 390 in FIG. 2.

The modified preliminary calibration curve resulting from determining the shift in the measured ETD reagent mass against a theoretical value, using the preliminary calibration curve, is stored in the memory of the system controller 200. The method then loops back to step 320, where sample ions are again directed into the mass spectrometer 10 from the primary ion source 20, this time over a second time period $t_2$. A raw mass spectrum obtained from sample analysis during that time period $t_2$ is mass calibrated using the updated calibration curve from step 390.

Returning to step 370, if the logic determines that the difference between the adjusted, measured mass of the ETD reagent is greater than the preprogrammed threshold, in that case the method follows the steps on the right hand side of FIG. 2. At step 400, instead of calculating a modified preliminary calibration curve using the difference between the adjusted measured ETD reagent mass and the theoretical mass of that, the system controller 200 instead initiates a full mass recalibration of the mass spectrometer to obtain an updated mass calibration curve. This may be achieved by replacing the sample with a calibration mix (as is carried out when first calibrating the mass spectrometer, at step 300), or may alternatively and less disruptively may be achieved by acquiring spectra with a lock mass or masses present, for example by adding an internal calibrant (lock mass or masses) to the sample, where a lock mass is not already present. At step 410, the memory of the system controller 200 is updated using the results of the newly obtained calibration curve, and this is then used, during a next period of sample analysis $t_2$, to carry out mass adjustments to the resulting mass spectrum.

The process repeats around the loop (either via an adjustment to the calibration curve based on the ETD reagent measurements, or a full recalibration), until the experiment concludes. In second and subsequent iterations of the method shown in FIG. 2, the adjusted measured ETD reagent ion mass may be compared with either a theoretical mass stored in the memory of the system controller 200 (that is, a mass to charge ratio of the reagent ions calculated on the basis of the constituent elements and the charge state of the reagent ion), or alternatively the adjusted measured ETD reagent ion mass may be compared with a previously measured and adjusted ETD reagent mass stored in the system controller memory. The term "reference mass" is employed hereinafter to signify either such actual or known/measured mass.

Moreover, the m/z of the sample ion data may be corrected using one or other of the preliminary mass calibration, the modified preliminary mass calibration or the updated mass calibration. The criterion employed to choose which mass calibration to use for correction of the sample data could be whether the sample ion data was acquired closer in time to when the preliminary mass calibration was carried out (step 300), or closer either to the time when the external calibrant ions are analysed (step 330), or to the point at which recalibration is carried out (step 400).

In summary, small shifts in system parameters, as determined by small shifts in the difference between the adjusted measured ETD reagent mass and its reference mass, can be treated as perturbations to the existing calibration curve, resulting in a beneficially correction to that curve from a single empirically determined data point (the mass of the ETD reagent), as explained above. However, correction of measured masses of sample ions, particularly those having masses at points along the calibration curve away from the ETD reagent mass, becomes increasingly unreliable as the system parameters shift further. Thus, the method illustrated in FIG. 2 provides for a relatively rapid and beneficial recalculation of the calibration curve when small systems parameter changes occur, yet still provides a full recalibration of the mass spectrometer 10 when determined to be analytically desirable. Moreover, the relatively rapid measurement of the ETD reagent between sample analysis periods provides the system with an informed (data dependent) decision as to when full recalibration is necessary.

Figure 3:
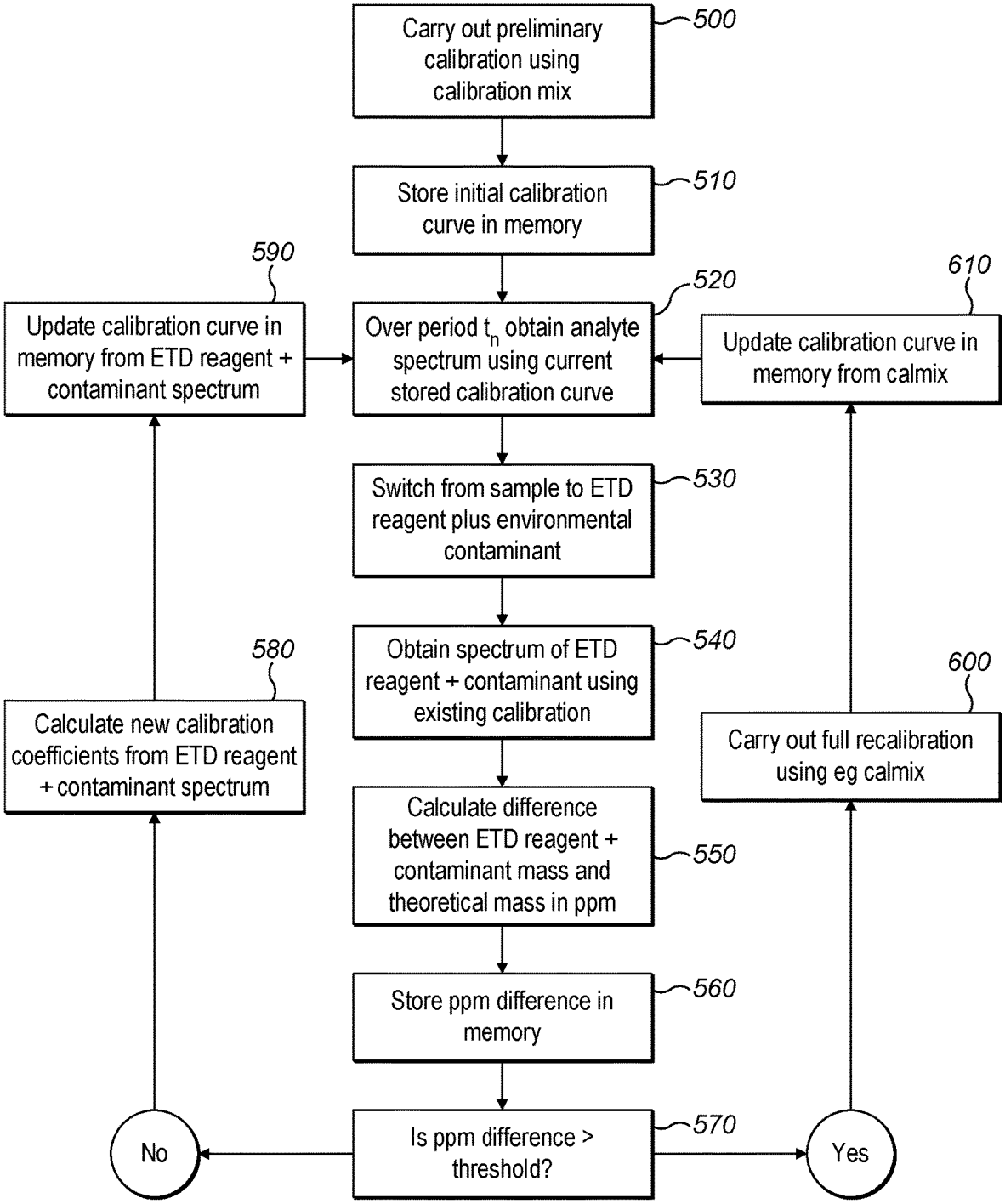
FIG. 3 shows a flow chart of a mass calibration technique according to a second exemplary embodiment of the present invention.

FIG. 3 shows a flow chart representing an alternative embodiment of a mass calibration method in accordance with the present invention. The embodiment of FIG. 3 shares many similarities with the embodiment of FIG. 2; where that is the case, the description of FIG. 3 will refer back to FIG. 2 for the sake of brevity and to avoid unnecessary repetition. It is to be understood that, unless otherwise discussed, the considerations and advantages set out in respect of FIG. 2 are equally applicable to FIG. 3.

As with the embodiment of FIG. 2, the first stage of the mass calibration process according to the embodiment of FIG. 3 is to carry out a preliminary calibration of the mass spectrometer 10, using a calibration mix. This is shown at step 500. Once a preliminary calibration curve has been obtained using the calibration mixture, it is stored in memory for use in future experimental analyses (step 510). Next, at step 520, a sample to be analysed is supplied to the primary ion source 20 and introduced into the mass spectrometer 10 as discussed in connection with FIGS. 1 and 2. The preliminary calibration curve stored in the memory of the controller 200 is applied to the resulting measured mass spectrum so as to correct for errors in the measured masses of the sample ions and their fragments.

Such sample analysis is carried out over a first period $t_1$ of a plurality of periods $t_n$ (n=1, 2, 3 . . . ).

At the end of the period $t_1$, the system controller 200 prevents further sample ions from entering the main vacuum chamber of the mass spectrometer 10. At step 530, ETD reagent ions are introduced into the mass spectrometer 10 via the RIS 50 instead as described above with reference to FIG. 2.

Along with the ETD reagent ions (eg fluoranthene) from the RIS 50, ions of one or more environmental contaminant(s) are introduced into the mass spectrometer. For example, contaminants may come from tubing used in ESI ion sources and chromatographic systems or from materials used to form the RIS 50 or the supply conduits to or from it. A common contaminants from tubing is polydimethylcyclosiloxane, and ions of this may be introduced along with the fluoranthene ions; molecules derived from the environment external to the mass spectrometer such as floor cleaning products, glues and the like could also be employed as the contaminant ions. The primary considerations in respect of the contaminant to be chosen are that the ion has a well defined peak, at an m/z well separated from that of the ETD reagent. The ETD reagent, fluoranthene described by way of specific example only here, has a peak at around 202 Da, and a suitable peak of the exemplary environmental contaminant, polydimethylcyclosiloxane, is at around 445 Da, that is to say, well spaced from the ETD reagent peak. At step 530 of FIG. 3, the ETD reagent and the environmental contaminant are introduced together from the RIS 50 into the mass spectrometer 10. This may be achieved by having the system controller 200 apply an RF potential to the quadrupole mass filter 80 with two notches, one to allow the ETD reagent to pass (at around 202 Da in the present example), and a further notch to allow passage of the environmental contaminant (for example at 445.120025 Da for the chosen polymer of polydimethylcyclosiloxane). At step 540, a mass spectrum is obtained of both the ETD reagent ions and also the environmental contaminant ions. The RIS 50 supplies the ETD reagent ions and environmental contaminant ions to the mass spectrometer 10 for a period necessary to allow the capture of a spectrum containing both the ETD reagent and the environmental contaminant ions.

Thus it is to be understood that the specific example of FIG. 3 proposes to measure the mass of a contaminant that is either inherent in the RIS 50, as a consequence of the construction of the components of the RIS 50 or from other external environmental contaminants. Of course, the contaminant may be present in the ions entering the mass spectrometer at steps 330/340 of FIG. 2; the distinction is that either these contaminant ions are not measured in the method of FIG. 2 (for example by filtering them out using the quadrupole mass filter 80 with a single narrow band pass notch around that of the ETD reagent), and only the ETD reagent ions are used for the purposes of recalibration in that case, or these contaminant ions are measured in the ETD reagent spectrum at step 340 but their measurement is not used in the subsequent steps 350, 360 and 370.

The specific identity of the environmental contaminant is not critical to the method, provided only that it provides a well-defined peak in a mass spectrum, which can be measured accurately following a calibration.

Although not preferred, it will also be understood that one or more lock masses (that is, externally and deliberately added ion species) may be employed along with the ETD reagent ions as well/instead of the environmental contaminant ions. The downside of such a technique is that the more different ion species need to be measured, the longer will be the down time between sample analyses and the more complex the arrangement of the spectrometer becomes in order to supply the further ion species.

The positions of the fluoranthene and the polydimethylcyclosiloxane peaks in the "raw" data obtained are adjusted using the current stored calibration curve. In respect of the first loop of FIG. 3 following initial calibration, the current stored calibration curve is the initial calibration curve (step 510).

Once the measured mass of the ETD reagent and environmental contaminant ions have been adjusted using the preliminary calibration curve (in respect of the first iteration of FIG. 3), the adjusted measured ETD reagent and contaminant ion masses are compared with their respective theoretical masses stored in the memory of the system controller 200 (step 550). By analogy with the method described in connection with FIG. 2, in an alternative embodiment of FIG. 3, the reference masses of the ETD reagent and environmental contaminant could be adjusted measured ETD reagent and environmental contaminant ion masses using the preliminary calibration curve where the measured ETD mass and the measured environmental was taken between the initial calibration (step 300) and the start of the sample analysis (step 320). A difference between the adjusted measured masses and the nominal theoretical masses, in parts per million (ppm), is then also stored in the memory of the system controller 200 (step 560).

At step 570, logic in the system controller 200 compares the stored mass differences from step 560, with threshold differences which are also pre-stored in memory. These thresholds may be preconfigured as a system setting or may be user configurable.

In one embodiment, the difference between the measured and theoretical fluoranthene masses may be compared with a fluoranthene threshold, and the difference between the measured and theoretical environmental contaminant masses may be compared separately with an environmental contaminant threshold. From that, a decision may be taken whether to use the discrepancies between the measured and theoretical masses to update the existing calibration curve, or whether a full recalibration (using a calibration mix or internal lock mass) is desirable. For example, the system controller 200 may decide to carry out a full recalibration when both the ETD reagent and the environmental contaminant mass differences each exceed the threshold, or when at least one but not necessarily both exceed their individual thresholds. More complex weighted decisions may be taken (for example, it may be established either theoretically or empirically that a relatively small shift in the measured mass of one of the external calibrant ions (ETD reagent or environmental contaminant) is likely to be indicative of a need to carry out a full recalibration, whereas a relatively larger shift in the measured mass of the other of the external calibrant ions is tolerable before the resulting mass calibration curve needs to be fully recalculated using a calibration mix or by adding lock masses to the sample as internal calibrants. Instead of comparing two separate thresholds, of course, a single threshold representing an average (weighted or otherwise) can be employed, and compared with a similarly calculated average of the measured ETD reagent and environmental contaminant ion masses.

If the comparison determines that the difference(s) is/are below the stored threshold(s), then the method proceeds along the logical path shown on the left hand side of FIG. 3. At step 580, the existing calibration curve (which, in the first loop, is the initial calibration curve determined prior to the beginning of the experiment using the calibration mix) is adjusted. Adjustment of the calibration curve parameters is based upon the measured difference(s) between the adjusted measured ETD reagent and environmental contaminant masses, and the theoretical masses thereof.

The modified calibration curve resulting from determining the shift in the measured ETD reagent and environmental contaminant masses against their theoretical values, using the preliminary calibration curve, is stored in the memory of the system controller 200. The method then loops back to step 520, where sample ions are again directed into the mass spectrometer 10 from the primary ion source 20, this time over a second time period $t_2$. A raw mass spectrum obtained from sample analysis during that time period $t_2$ is mass calibrated using the modified calibration curve from step 590.

Returning to step 570, if the logic determines that the difference between the adjusted, measured mass of the ETD reagent is greater than the preprogrammed threshold, in that case the method follows the steps on the right hand side of FIG. 3. At step 600, instead of calculating a modified calibration curve using the difference between the adjusted measured ETD reagent and environmental contaminant masses and the theoretical masses of those, the system controller 200 instead initiates a full mass recalibration of the mass spectrometer. As with the method of FIG. 2, this may be achieved by using a calibration mix or may be carried out as part of sample analysis by adding one or more lock masses to the sample to act as internal calibrants. At step 610, the memory of the system controller 200 is updated using the results of the newly obtained calibration curve, and this is then used, during a next period of sample analysis $t_2$, to carry out mass adjustments to the resulting mass spectrum.

The process repeats around the loop (either via an adjustment to the calibration curve based on the ETD reagent and environmental contaminant measurements, or a full recalibration), until the experiment concludes. As with FIG. 2, in subsequent iterations of FIG. 3, the calculation of the adjusted measured ETD reagent and environmental contaminant ion masses may be compared with either theoretical masses stored in the memory of the system controller 200 (that is, the mass to charge ratios of the reagent and contaminant ions calculated on the basis of the constituent elements and the charge states of the reagent and contaminant ions respectively), or alternatively the adjusted measured ETD reagent and environmental contaminant ion mass may be compared with previously measured and adjusted ETD reagent and environmental contaminant masses stored in the system controller memory. The term "reference mass" is employed hereinafter to signify either such actual or known/measured mass.

Again as with the method of FIG. 2, the m/z of the sample ion data may be corrected using one or other of the preliminary mass calibration, the modified preliminary mass calibration or the updated mass calibration. The criterion employed to choose which mass calibration to use for correction of the sample data could be whether the sample ion data was acquired closer in time to when the preliminary mass calibration was carried out (step 500), or closer either to the time when the external calibrant and environmental contaminant ions are analysed (steps 530 and 540), or to the point at which recalibration is carried out (step 600).

The benefit of the method of FIG. 3 over the method of FIG. 2 is that it provides two data points rather than just one, when determining whether to carry out a full recalibration or not. It also provides two data points rather than one in the calculation of a new calibration curve when that is based upon changes in the measured mass(es) of the external calibrant(s) (ie steps 380 and 580 of FIGS. 2 and 3 respectively). On the other hand, there is a time penalty associated with having to measure two external calibrant ion masses rather than just one. Where the mass analyser 100 is an Orbitrap, the time penalty is relatively insignificant (some milliseconds compared to a 500-1000 ms analysis). Where a multireflection time of flight mass analyser (MR-TOF MS) is employed, however, the time penalty is similar (a few milliseconds) to the analysis time but this is still acceptable as each analysis time is short.

It will be appreciated that, if the offset value (the difference(s) between the adjusted external calibrant mass(es)) is neither below or above the threshold but rather exactly the same as the threshold, the controller can be configured to either modify the preliminary mass calibration using the corrected external calibrant ion data to generate a modified preliminary mass calibration, or may alternatively carry out a recalibration of the mass spectrometer to generate an updated mass calibration.

The period $t_n$ may be chosen in various ways. As will be understood from the foregoing, the purpose of carrying out periodic analysis of the ETD reagent (and, optionally, the environmental contaminant) ions is to ascertain whether or not the physical parameters of the mass spectrometer have drifted to an unacceptable extent, from those which were present when the previous full calibration was carried out (and to correct for any changes if so). The technique described herein provides significant advantages over the prior art techniques described in the Background section—particularly, that a relatively quick assessment can be made, using the ETD reagent/ETD reagent and environmental contaminant, to see whether a full recalibration is necessary. Nevertheless, even with the techniques described here, there are still disadvantages to be assessed. Switching to the RIS 50 for supply of ETD reagent for calibration checking has penalties in terms of sample throughput. In currently preferred embodiments, the sample ions are filtered out by the quadrupole mass filter 80 when the ETD reagent is to be used as an external calibrant to check and determine any drifts. Capturing/storing those sample ions during the period when the ETD reagent is being supplied by itself to the mass analyser is possible in principle but this introduces further complexity. If the sample ions are not stored, then they are of course lost. In other words, there is a trade-off between on the one hand carrying out the calibration check using the external calibrant(s) too regularly (reducing sample throughput and also potentially resulting in a loss of sample ions) and not carrying out the calibration check regularly enough (resulting in unacceptable mass inaccuracies in sample analysis). In some embodiments, the external calibrant ion source (e.g. RIS) could be located in the mass spectrometer so that the sample ions and external calibrant ions follow substantially different paths to the mass analyser. For example, the external calibrant ion source could be located relatively far from the primary ion source (e.g. at an opposite end of the instrument as in the Orbitrap® Elite mass spectrometer). In this way, the sample ions do not need to be lost but rather can be stored in an ion store concurrently with introducing the external calibrant ETD reagent into the mass analyser.

In a simplest form, the length of the period $t_n$ may be predetermined and constant for all n, that is, so that $t_1=t_2=t_3 \ldots$ In some embodiments, the period $t_n$ may be a period in the range from 1 to 1000 seconds, or 1 to 100 seconds, or 1 to 50 seconds, or 1 to 10 seconds, e.g. 1 sec, or 2 sec, or 5 sec, or 10 sec, . . . . However, the period $t_n$ may be shorter or longer than these exemplary periods. In a more sophisticated form, the period $t_n$ may be adjusted based upon information obtained previously or during the course of present experimentation. For example, it may be possible to employ a non-linear (but nevertheless predetermined) regularity (that is, $t_n \neq t_2 \neq t_3 \ldots$) using prior learning of the parameters of the specific mass spectrometer and how they shift over time in the particular location and environment of the mass spectrometer.

As still a further alternative, given that one of the strongest effects on calibration is temperature drift, a temperature sensor (or a series of temperature sensors) might be employed to provide real time feedback. Note that such temperature sensors would not be provided in an attempt directly to recalibrate the mass spectrometer; as discussed in the Background section this has several problems. Instead the purpose of the temperature sensor(s) would be to provide a gross indication that a check on calibration should be carried out—that is, the temperature sensor(s) could be employed heuristically to determine the period $t_n$ for a particular n. For example, the controller 200 could be configured so that a change in temperature as measured by the sensor(s), of an amount that exceeds a threshold, could be employed to trigger a switch from sample analysis to a calibration check using the external calibrant ions—potentially leading in turn to a decision that a full recalibration is needed. Thus, in this example, $t_n$ would not be predetermined (in the sense that the time over which the sample ions would be analysed in step 320 would be known at the start of that period $t_n$) but would instead be determined "on the fly". Still further, it would be possible to use previously obtained data from chromatography of the same sample, to identify periods during the analysis when ions of analytical interest are not present. The ETD reagent can then be injected into the mass spectrometer 10 during those periods. Generally, as noted, recalibration using the ETD reagent may be carried out more regularly when employing an mr-TOF than an Orbitrap as the mass analyser, because the time overhead is much lower for an mr-TOF and because the mass calibration of an mr-TOF is more susceptible to temperature changes than an Orbitrap.

Both FIG. 2 and FIG. 3 show a serial process. That is to say, as shown and as described, the sample measurement and analysis, the external calibrant measurement and analysis, and the subsequent data processing are carried out sequentially. However in order to maximize throughput whilst retaining the benefits of the present invention, at least some of the method steps could be carried out in parallel.

For example, referring to FIG. 2 for simplicity, calculation of the corrected masses of the measured sample ions (following the obtaining of a "raw" mass spectrum in step 320) could be carried out (on the basis of the previously stored calibration curve) whilst the mass spectrometer 10 is receiving ions from the RIS 50 and obtaining a "raw" mass spectrum of the ETD reagent ions (step 340). Similarly the correction of the measured mass of the ETD reagent ions using the existing calibration curve, and the comparison of that adjusted mass with the threshold mass, can be carried out whilst a next round of sample ion injection and detection is taking place. Such parallel processing does require an assumption to be made that no full recalibration is necessary; that assumption is likely to be correct at least during early rounds of the method shortly after the initial calibration has been carried out.

When that assumption is valid, then the new calibration curve can be calculated based upon the difference between the adjusted ETD reagent mass and the reference value, during the next sample data collection period $t_{n+1}$. Evidently, the calculation of the updated calibration curve must be completed before it can be applied to the data that has been/is being collected during that period $t_{n+1}$.

As a further variation to the methods described above, the system controller may be configured to carry out a full recalibration (using a calibration mix or an internal lock mass or lock masses) even if the difference at step 370/570 is below the threshold, when a certain predetermined period of time has elapsed. For example, the system controller 200 may be configured to force the logic to step 400 or 600 after X seconds/minutes regardless of the outcome of the assessment of step 370/570, or after a certain number of cycles of the logic loop (ie, when the value of n reaches a threshold number). The reason for this is as follows. Consider several iterations of the loop shown in FIGS. 2 and 3. Between each iteration, it may be assumed that a temperature change will result in a calculated difference between the adjusted measured mass of the external calibrant(s). Each individual iteration may result in a difference that is below the threshold. In some situations, the changes may counteract each other (so that a positive change during a first iteration may be offset by a negative change in a subsequent iteration).

However it is more likely that the changes will be all in the same direction as a result of a longer term unidirectional temperature drift. In that case, although each individual change may result in a mass difference that is lower than the threshold, the cumulative shift over several iterations may be significantly more than the individual threshold amount. In this case, it may be prudent to carry out a full recalibration. More preferably, of course, any changes may in each case be compared with the initial calibration obtained from the calmix employed in initial experimental setup and then stored in memory.

Although the use of the external calibrant (s) to provide one or two data points provides for a useful recalibration for small mass calibration shifts, it may be less accurate over cumulatively larger mass shifts.

Of course, as an alternative approach to carrying out a periodic full recalibration even if none of the individual mass calibrations shifts exceed the threshold, it would be possible for the system controller 200 to retain in memory the all previous calibration curves, including the most recent calibration curve that resulted from a full (re)calibration, as well as the calibration curve that is being modified in accordance with the measured shifts in the external calibrant mass calibrations. The temperatures inside the instrument at which each calibration curve was calculated are also retained in memory using temperature sensors provided for other purposes within the mass spectrometer. In that case, the system controller 200 could compare the mass shift of the external calibrant(s) to the reference mass(es), using both the most recent calibration curve (which may itself have been modified based upon measured mass shifts in the external calibrants from previous iterations), and also using the most recent calibration curve obtained by a full calibration. If both comparisons determine that the difference is less than the threshold then the method can proceed via the left hand loop of FIGS. 2 and 3. If however the comparison of the external calibrant mass(es) (adjusted using the most recent calibration curve) to the reference mass(es) results in a mass difference below a threshold, but a comparison of the external calibrant mass(es) (adjusted using the most recent full (re)calibration curve) to the reference mass(es) results in a mass difference above that threshold—or indeed above a second, perhaps higher threshold—then in that case the system controller 200 can follow the right hand part of FIGS. 2 and 3 so as to trigger a full recalibration of the mass spectrometer using an internal lock mass or masses, or a separate calibration mix.

In the foregoing description, the calibration techniques have been described in the context of an FTMS-type mass analyser. The invention may, however, equally be implemented using other mass analysers such as a time of flight (TOF) mass analyser. In the latter case, the calibration techniques described above can be applied to time of flight data rather than mass/mass to charge ratio data, since, as is well known, time of flight and m/z are directly proportional. The term "mass" is thus to be construed so as to cover m/z and times of flight as well. The invention may, in fact, have further advantages when applied to the problem of periodic mass calibration on a mass spectrometer having a TOF mass analyser. In that case, the time penalty incurred when acquiring the external calibrant ion data is proportionally less compared to the time spent acquiring sample ion data since the time taken to acquire a single spectrum using a TOF mass analyser is much less than the time required to acquire a spectrum using an FTMS mass analyser.

Figure 4:
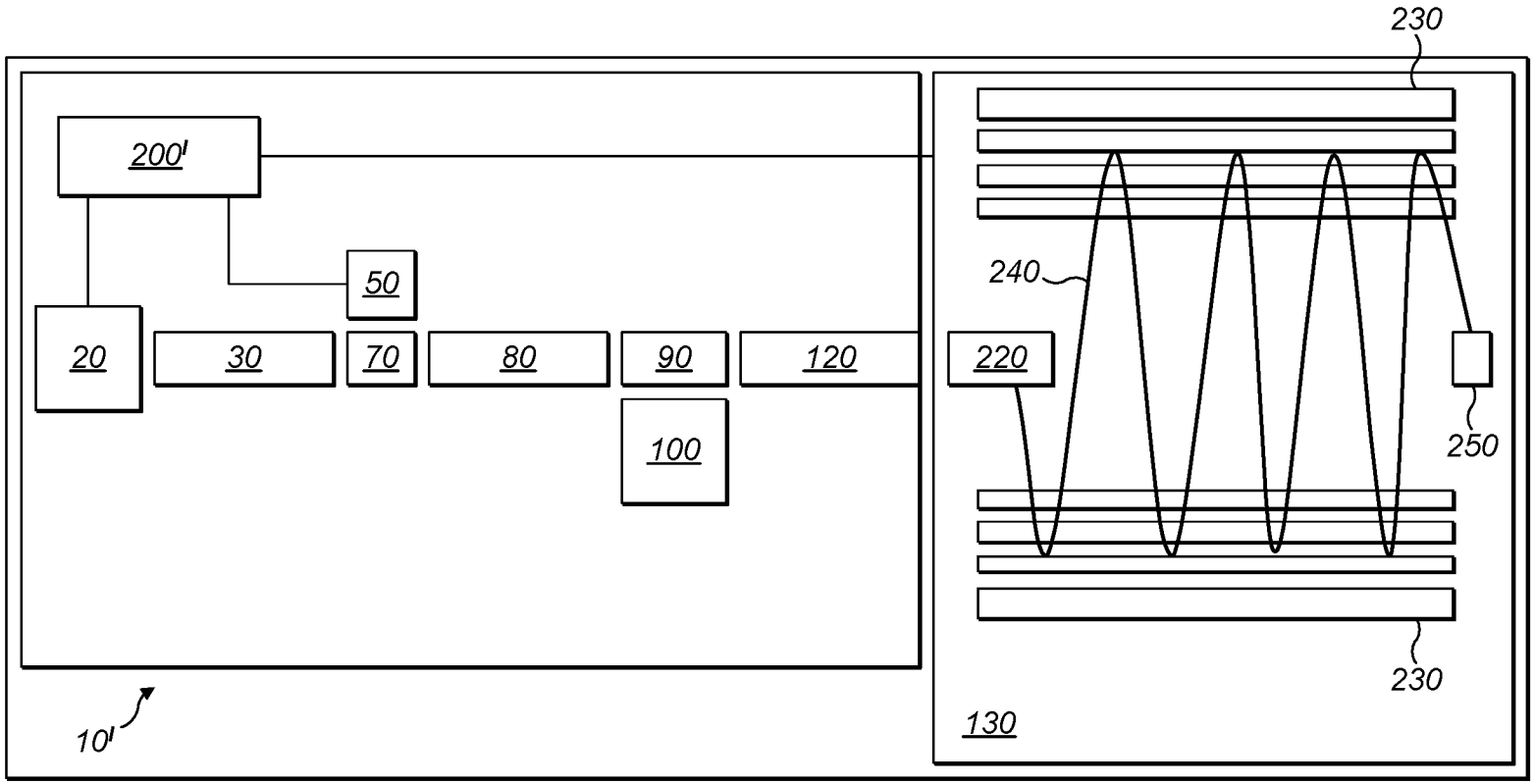
FIG. 4 shows a schematic layout of another embodiment of a mass spectrometer suitable for implementation of the mass calibration techniques that embody the present invention.

FIG. 4 shows a mass spectrometer 10′ exemplifying another arrangement for the implementation of embodiments of the invention. The arrangement shown in FIG. 4 is a schematic view of a hybrid Orbitrap® TOF mass spectrometer. It is to be reiterated that the arrangement of FIG. 4, which employs as a mass analyser both an Orbitrap® mass analyser and a TOF mass analyser, has been chosen simply for the purposes of illustrating the mass calibration techniques embodying the present invention. Moreover, components common to FIGS. 1 and 4 have been labelled with like reference numbers The mass spectrometer 10′ of FIG. 4 includes a primary ion source 20 such as an electrospray ionization (ESI) or atmospheric pressure chemical ionization (APCI) source. Ions from a sample to be analysed are generated in the ion source 20 at atmospheric pressure and enter an S lens (ion guide) 30 in the form of an ion funnel. In other embodiments, the S lens 30 can be a multipole or may comprise an ion mobility device.

A second ion source is a reagent ion source (RIS) 50, which is provided to allow electron transfer dissociation (ETD) experiments to be carried out, as will be explained further below. The reagent ion source 50 has its own dedicated continuous introduction system to allow delivery of a highly stable flow of reagent. In the preferred embodiment, the reagent is fluoranthene, supplied from a reagent container (not shown in FIG. 4). The reagent ion source 50 operates in the same way as the RIS 50 shown in FIG. 1 in order to provide an intense, stable current of fluoranthene radical anions and a moderate current of fluoranthene radical cations via an ioniser. As will be described in further detail below, the primary ion source 20 and the RIS 50 are each under the control of a system controller 200' that is able to control the ions that are injected into the downstream components of the mass spectrometer 10′.

After passing through an ion guide in a second vacuum chamber (not shown in FIG. 4), the ions pass through an active ion beam guide (again not shown in FIG. 4) and then enter a quadrupole mass filter 80 where a mass range of ions of analytical interest may be isolated. Downstream of the quadrupole mass filter 80 is a further ion lens (not shown) and a curved linear ion trap (C-trap) 90. The C trap 90 is, as will be understood, operable in various modes so as to trap ions and eject them orthogonally to an Orbitrap® mass analyser 100 or longitudinally downstream.

In a first mode, ions arriving from the quadrupole mass filter 80 may be ejected longitudinally along the curved axis of the C trap 90, through another ion guide (not shown), and then into a collision/ETD cell 120. From here, ions pass into a rectilinear ion trap (R-trap) 220 having a straight axis. The R-trap 220 is operable in various modes so as to trap ions and eject them orthogonally or return them longitudinally towards the C-trap 90. In one mode, ions are ejected orthogonally from the R-trap 220 to a high resolution time of flight (TOF) mass analyser 230, which is a multi-reflection TOF mass analyser, for mass analysis.

In a second mode, sample ions injected into the collision/ETD cell 120, after optional mass selection by the quadrupole mass filter 80, may be trapped therein and subject to reaction with reagent ions from the reagent ion source 50 to produce fragment ions. The collision/ETD cell 120 may also be configured to allow collision induced dissociation of sample ions as an alternative to ETD. Following fragmentation, the ions can be transferred from the collision/ETD cell 120 to the R-trap 220, where they may be trapped and cooled in a potential well along the longitudinal axis thereof. Once cooled, the trapped ions can be ejected orthogonally as a short ion packet from the R-trap 220 towards the high resolution TOF mass analyser 230 for mass analysis. The TOF mass analyser comprises two planar opposing ion mirrors 240 extending along an ion drift direction towards an ion detector 250. Upon entering the TOF mass analyser 230 at an angle to the planar surfaces of the ion mirrors, the ions reflect multiple times between the ion mirrors whilst proceeding along the drift direction thereby following a zigzag ion path until they reach the ion detector 250. As will be familiar to those skilled in the art, the ions separate along the zigzag ion path due to their different flight times that result from their different mass to charge ratios. A time of flight spectrum is thereby acquired by the ion detector. A mass spectrum may then be derived by the controller 200' from the resulting time of flight spectrum as known in the art. Further details of the TOF mass analyser are not relevant to the present invention and will not be described further.

The mass spectrometer 10' of FIG. 4 is under the control of a system controller 200'. Although this carries out various functions, in relation to the present invention, the system controller 200' is configured to control the admission of ions from the primary ion source 20 and the RIS 50 for the reasons explained further below. The system controller 200' is also in communication with the mass analysers 100 and 230.

The embodiments of mass calibration methods embodying the present invention described with reference to FIGS. 2 and 3 can be performed mutatis mutandis using the mass spectrometer 10' of FIG. 4. A preliminary mass calibration of the TOF mass analyser 230 of the mass spectrometer 10' is performed using a calibration mix, lock masses etc. Ions from a sample to be analysed are introduced from the primary ion source 20 into the mass spectrometer over a time period t, using the TOF mass analyser 230 to obtain sample ion data representative of the mass to charge ratio of one or more sample ions derived from the sample. Subsequently, the sample ion data is corrected by the controller 200' using the stored preliminary mass calibration. At the end of the time period t, sample ions are stopped from being introduced into the spectrometer 10' and external calibrant ions in the form of the ETD reagent are instead introduced into the mass spectrometer 10' from the reagent ion source 50. Using the TOF mass analyser of the mass spectrometer, ETD reagent ion data representative of the mass to charge ratio of the ETD reagent ions is obtained, the ETD reagent ions being introduced into the mass spectrometer separately from the sample ions so that the external calibrant ion data is obtained in the absence of sample ions. Then the ETD reagent ion data is corrected by the controller 200' using the preliminary mass calibration so as to generate corrected ETD reagent ion data. Next the corrected ETD reagent ion data is compared with reference ETD reagent ion data representative of the reference mass to charge ratios of the ETD reagent ions to generate an offset value or difference representative of the mass difference between the corrected and reference ETD reagent ion data. The offset value is compared with a threshold stored by the controller 200' and if the offset value is below the threshold, the controller 200' modifies the preliminary mass calibration using the corrected external calibrant ion data to generate a modified preliminary mass calibration but if the offset value is above the threshold, the controller 200' carries out a full recalibration of the mass spectrometer, eg. using a calibration mix, lock masses etc., to generate an updated mass calibration. The steps then repeat in a loop in the fashion described with reference to FIGS. 2 and 3. The embodiment of FIG. 3 can be performed mutatis mutandis using the spectrometer of FIG. 4, for example when contaminant ions are present with the ETD reagent ions for mass analysis.

The invention claimed is:

1. A method of calibrating a mass spectrometer comprising:

(a) carrying out a preliminary mass calibration of the mass spectrometer;

(b) introducing, from a first ion source, ions from a sample to be analysed into the mass spectrometer;

(c) over a time period t, using a mass analyser of the mass spectrometer to obtain sample ion data representative of the mass to charge ratio of one or more sample ions derived from that sample to be analysed;

(d) correcting the sample ion data using a mass calibration;

(e) at the end of the time period t, from a second ion source, introducing external calibrant ions into the mass spectrometer;

(f) using the mass analyser of the mass spectrometer to obtain external calibrant ion data representative of the mass to charge ratio of the external calibrant ions, the external calibrant ions being introduced into the mass spectrometer separately from the sample ions so that the external calibrant ion data is obtained in the absence of sample ions;

(g) correcting the external calibrant ion data using the preliminary mass calibration so as to generate corrected external calibrant ion data;

(h) comparing the corrected external calibrant ion data with reference external calibrant ion data representative of the reference mass to charge ratios of the external calibrant ions to generate an offset value representative of the mass difference between the corrected and reference external calibrant ion data;

(i) comparing the offset value with a threshold;

(j) if the offset value is below the threshold, modifying the preliminary mass calibration using the corrected external calibrant ion data to generate a modified preliminary mass calibration;

(k) if the offset value is above the threshold, carrying out a recalibration of the mass spectrometer to generate an updated mass calibration; wherein the mass calibration used for correcting the sample ion data in step (d) is one of: the preliminary mass calibration of step (a), the modified preliminary mass calibration of step (j), or the updated mass calibration of step (k).

2. The method of claim 1, further comprising, after the step (k), substituting the preliminary mass calibration obtained in step (a) with the updated mass calibration, and repeating the steps (b) to (k) with the updated mass calibration.

3. The method of claim 2, in which the time period t over which the sample ion data is obtained in the repeated step (c) is the same length as the time period t over which the sample ion data was obtained during the preceding iteration of the step (c).

4. The method of claim 2, wherein the time period t over which the sample ion data is obtained in the repeated step (c) is different to the time period t over which the sample ion data was obtained during the preceding iteration of the step (c).

5. The method of claim 1, further comprising, after the step (j), substituting the preliminary mass calibration with the modified preliminary mass calibration, and repeating the steps (b) to (k) with the modified preliminary mass calibration.

6. The method of claim 1, in which the step (a) of carrying out a preliminary mass calibration comprises (i) introducing a calibration mix of ions into the mass analyser, the calibration mix comprising a plurality of ion species having a known mass to charge ratio;

(ii) analysing the ions in the calibration mix using the mass analyser;

(iii) obtaining calibration mix ion data representative of the measured mass to charge ratio of the ions in the calibration mix whose mass to charge ratio is known; and (iv) deriving, from a comparison of the calibration mix ion data with reference data representative of the known mass to charge ratio of the ions in the calibration mix, the preliminary mass calibration.

7. The method of claim 6, wherein the step (iv) of deriving the preliminary mass calibration comprises generating a preliminary calibration curve by fitting the calibration mix ion data to the reference data using regression analysis.

8. The method of claim 1, in which the step (k) comprises (i) adding one or more lock mass ion species to the sample to be analysed, the or each lock mass ion species having a known mass to charge ratio and/or TOF, if one or more lock mass ion species are not already present in the sample to be analysed;

(ii) analysing the lock mass ions entrained with the sample ions, using the mass analyser;

(iii) obtaining lock mass ion data representative of the measured mass to charge ratio of the lock mass ions whose mass to charge ratio is known; and (iv) deriving, from a comparison of the lock mass ion data with reference data representative of the known mass to charge ratio of the lock mass ions, an updated preliminary mass calibration to replace the existing preliminary mass calibration in further iterations of the method.

9. The method of claim 1, wherein the step (e) comprising introducing external calibrant ions of a single ion species.

10. The method of claim 9, wherein the single ion species is an electron transfer dissociation (ETD) reagent such as fluoranthene.

11. The method of claim 1, wherein the step (e) comprises introducing external calibrant ions of two separate ion species.

12. The method of claim 11, wherein the first of the two separate ion species is an electron transfer dissociation (ETD) reagent such as fluoranthene, and the second of the two separate ion species is an environmental contaminant of known mass to charge ratio and/or TOF, such as polydimethylcyclosiloxane.

13. A controller for a mass spectrometer, the mass spectrometer comprising a first ion source configured to generate sample ions, a second ion source configured to generate external calibrant ions, and a mass analyser, the controller being configured:

a) to instruct the mass spectrometer to carry out a preliminary mass calibration of the mass spectrometer;

b) to instruct the first ion source to introduce ions from a sample to be analysed into the mass spectrometer;

c) to obtain from the mass analyser, and over a time period t, sample ion data representative of the mass to charge ratio of one or more sample ions derived from that sample to be analysed;

d) to correct the sample ion data using the preliminary mass calibration;

e) at the end of the time period t, to cause the second ion source to introduce external calibrant ions into the mass spectrometer whilst preventing the first ion source from simultaneously introducing sample ions into the mass spectrometer;

f) to obtain external calibrant ion data representative of the mass to charge ratio of the external calibrant ions;

g) to correct the external calibrant ion data using the preliminary mass calibration so as to generate corrected external calibrant ion data;

h) to compare the corrected external calibrant ion data with reference external calibrant ion data representative of the reference mass to charge ratios of the external calibrant ions to generate an offset value representative of the mass difference between the corrected and reference external calibrant ion data;

i) to compare the offset value with a threshold;

j) if the offset value is below the threshold, to modify the preliminary mass calibration using the corrected external calibrant ion data to generate a modified preliminary mass calibration;

k) if the offset value is above the threshold, to instruct the mass spectrometer to carry out a mass recalibration thereof, so as to generate an updated mass calibration.

14. A mass spectrometer comprising a first ion source configured to generate sample ions, a second ion source configured to generate external calibrant ions, a mass analyser, and a controller in accordance with claim 13.

15. The mass spectrometer of claim 14, in which the mass analyser is one or more of a Fourier Transform Mass Spectrometer (FTMS), a Time of Flight mass spectrometer (TOF-MS); a linear (2D) quadrupole ion trap; a 3D (Paul) trap, and/or an electric and/or magnetic sector mass spectrometer.

16. The mass spectrometer of claim 15, in which the FTMS is an orbital trapping mass spectrometer.

* * * * *